US008469479B2

(12) United States Patent
Amit et al.

(10) Patent No.: US 8,469,479 B2
(45) Date of Patent: Jun. 25, 2013

(54) METHOD AND SYSTEM TO POSITION A SENSOR

(75) Inventors: Gal Amit, Bat Yam (IL); Ran Waidman, Rehovot (IL); Oren Bengigi, Mazkeret Batya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 339 days.

(21) Appl. No.: 12/946,060

(22) Filed: Nov. 15, 2010

(65) Prior Publication Data

US 2012/0120143 A1 May 17, 2012

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS

| | | | | |
|---|---|---|---|---|
| 5,724,259 | A | 3/1998 | Seymour et al. | |
| 6,474,767 | B1 | 11/2002 | Teshigawara et al. | |
| 6,563,524 | B1 * | 5/2003 | Regimbal et al. | 347/116 |
| 6,693,654 | B2 | 2/2004 | Shinohara | |
| 6,832,824 | B1 * | 12/2004 | Baker et al. | 347/19 |
| 7,027,185 | B2 | 4/2006 | Subirada et al. | |
| 7,502,116 | B2 | 3/2009 | Gila et al. | |
| 8,059,318 | B2 * | 11/2011 | Maebashi et al. | 358/504 |
| 2007/0291291 | A1 | 12/2007 | Vilar et al. | |
| 2010/0195121 | A1 * | 8/2010 | Flotats et al. | 358/1.5 |

FOREIGN PATENT DOCUMENTS

EP 1338870 A2 8/2003

OTHER PUBLICATIONS

Machine English Translation of JP 01-174160.*

* cited by examiner

*Primary Examiner* — Julian Huffman
*Assistant Examiner* — Sharon A Polk
(74) *Attorney, Agent, or Firm* — Garry Perry

(57) ABSTRACT

In one embodiment, a media is advanced in the process direction to cause a plurality of fiducials to successively appear within a sensor's focal width. Each fiducial includes a target and a background, with the target superimposed to the background. Each target has a substantially same target width, a substantially same optical density, and a position at a distinct distance from an edge of the media. Each background has an optical density less than the optical density of the targets and greater than an optical density of the media. An optical density for each fiducial is read utilizing the sensor. The target the sensor is most aligned with is discerned by identifying an identified fiducial with the highest-read optical density. Utilizing data indicative of a position of the discerned target relative to a desired position, the sensor is caused to move to the desired position.

20 Claims, 7 Drawing Sheets

METHOD AND SYSTEM TO POSITION A SENSOR

BACKGROUND

Printing devices may include an optical sensor that reads optical properties or features of patches that are printed upon a media. The patches' optical properties or features can be used as references to ensure proper registration of color separations, optical densities of different color separations, and dot areas of different color separations, and for calibration of other attributes of images printed by the printing device.

BRIEF DESCRIPTION OF THE DRAWINGS

The accompanying drawings illustrate various embodiments and are a part of the specification. The illustrated embodiments are merely examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

Color registration and other registration and/or calibration processes that utilize an optical sensor to analyze printed patches may require that the sensor be at an accurate location. If the sensor is not exactly in the right location (e.g. centered above the patch), the sensor's reading may be shifted, or even worse, unstable. For example, if the sensor is inaccurately placed during the reading of a target patch, an error may be caused by integration of reflected light from neighboring patches or from the substrate.

Embodiments described below were developed in an effort to accurately position a sensor at a desired location relative to calibration patches, and thereby minimize the inaccuracies that can result from sensor misplacement. The disclosed method and system allow for calibration of the sensor in a position in a manner that is not dependent upon an operator's skill. Additionally, the accuracy of the disclosed method and system can allow for the use of smaller calibration patches. The use of smaller calibration patches can reduce the ink & substrate costs associated with sensor position calibration, and thereby increase utilization.

The embodiments shown in the accompanying drawings and described below are non-limiting examples. Other embodiments are possible and nothing in the accompanying drawings or in this Detailed Description of Embodiments should be construed to limit the scope of the disclosure, which is defined in the Claims.

The following description is broken into sections. The first, labeled "Environment", describes an example environment in which embodiments may be implemented. The second section, labeled "Components", describes various physical and logical components utilized to implement various embodiments. The third section, labeled as "Operation", describes example embodiments of a method to position a sensor. The fourth section, labeled "Examples", describes examples of the method and system to position a sensor, according to embodiments of the disclosure.

Figure 1:
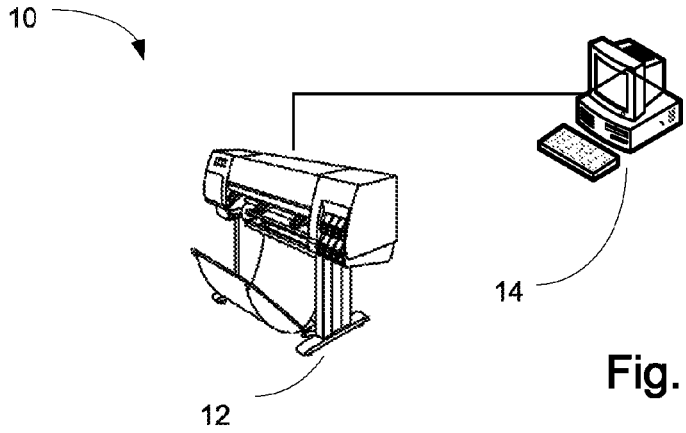
FIG. 1 depicts an example environment in which various embodiments may be implemented.

ENVIRONMENT: FIG. 1 depicts an example environment 10 in which various embodiments may be implemented. Environment 10 is shown to include printing device 12. Printing device 12 represents generally an assembly of components configured to produce printed images of media. Printing device 12, for example, may be used for printing photographs, forms, advertisements, coupons and the like. Host 14 represents generally any computing device capable of communicating print jobs to print system 12. Host 14 may also supply a user interface allowing a user to obtain status information and to configure printing device 12. In an embodiment, printing device 12 may operate in conjunction with one or more host computing devices capable of communicating print jobs to printing device 12. In an embodiment, printing device 12 connects directly or indirectly with host 14. In an embodiment printing device 12 is connected to a host via a cable or wireless or other means in a manner such that printing device 12 may receive instructions and print jobs from host 14. In another embodiment, printing device 12 may connect directly to one or more hosts 14 via the Internet. In an embodiment printing device 12 may operate in a standalone mode without being connected to host 14, the printing device 12 being configured to receive print jobs via the Internet, email or an external memory device.

Figure 2:
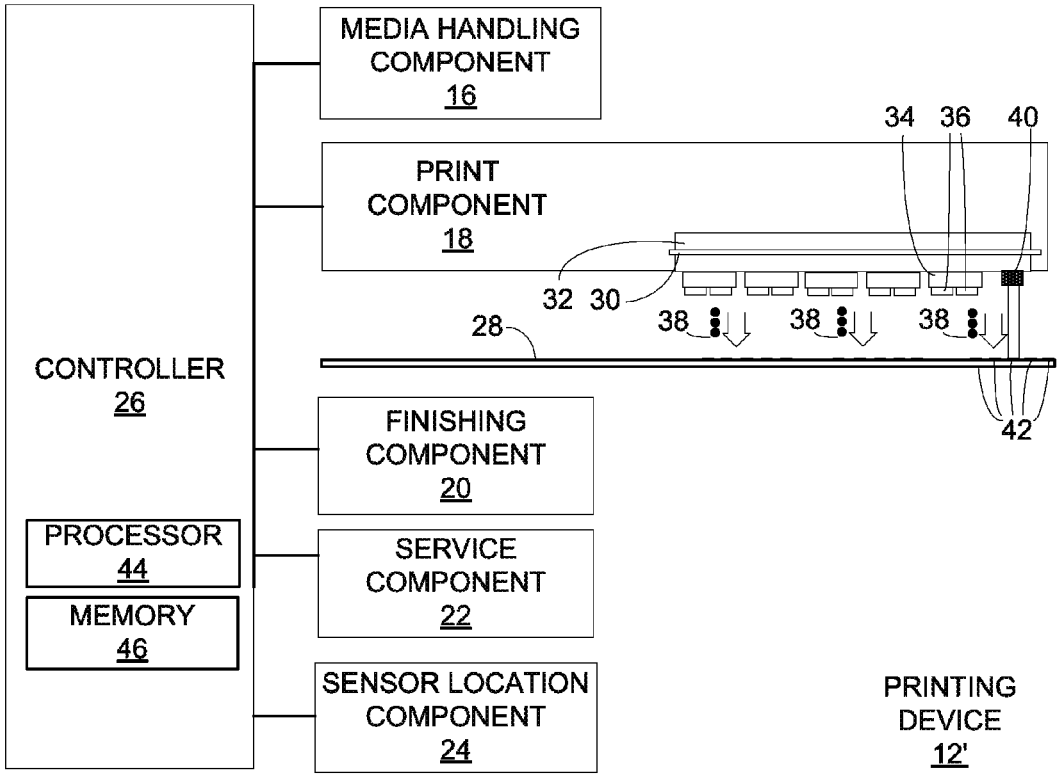
FIG. 2 depicts the physical and logical components of a printing device according to an embodiment.

FIG. 2 is an example block diagram of a printing device 12'. In this example, printing device 12' is shown to include a media handling component 16, a print component 18, a finishing component 20, a service component 22, a sensor location component 24, and a controller 26. Media handling component 16 represents generally any combination of hardware and programming capable of transporting media through the printing device 12'.

Print component 18 represents generally any combination of elements capable of being utilized to form desired images on media 28. Media 28 may include sheets, a continuous roll or web, or any other media on which a print image can be formed. In a given example, print component 18 may include a guide rod 30 that supports a reciprocating carriage 32. The reciprocating carriage 32 carries a fluid ejection mechanism 34. In an embodiment, each fluid ejection mechanism 34 includes multiple printheads 36 configured to dispense ink 38 or other fluid. As used in this specification, "printhead" includes a mechanism having a plurality of nozzles through which ink or other fluid is ejected. Examples of printheads are drop-on-demand inkjet printheads, thermo resistive printheads, piezo and resistive printheads. Some printheads may be part of a cartridge which also stores the fluid to be dispensed. Other printheads are standalone and are supplied with fluid by an off-axis ink supply.

Finishing component 20 represents generally any combination of hardware and programming capable of performing a finishing operation on media. Such finishing operations include cutting, folding, laminating or any other action that affects the physical nature of the print medium.

In an embodiment, service component 22 represents generally any combination of elements capable of being utilized to service print component 18 for issues other than sensor location. Where, for example, print component 18 includes a printhead 36, service component 22 may be configured to function as a printhead wiper, priming station, and/or spittoon. Service station component 22 may additionally be configured to function as a color calibrator and/or media alignment calibrator.

Figure 3:
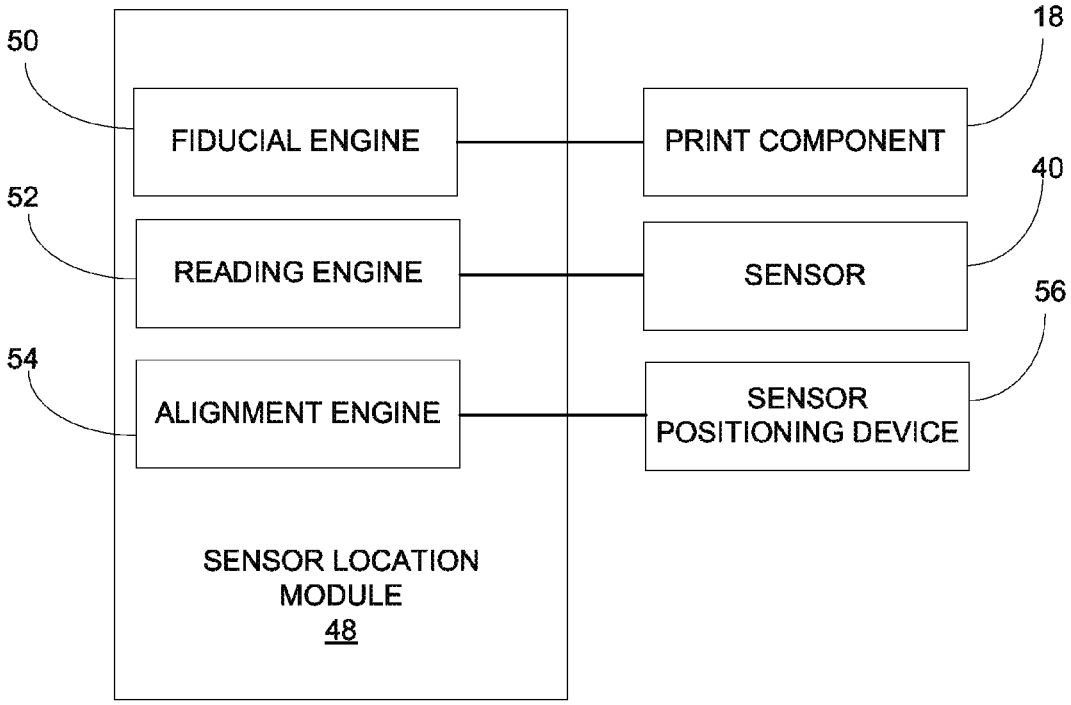
FIG. 3 depicts a sensor location module according to an embodiment.

As discussed in more detail below with reference to FIG. 3, sensor location component 24 represents generally any programming, that, when executed, implements the functionality of the sensor location module 48 of FIG. 3. In particular, sensor location module 48, when executed by controller 26, is responsible for accurately positioning a sensor 40 to minimize error when the sensor 40 is used to read color calibration patches, or other calibration patches, printed upon a media. In an embodiment the sensor 40 may be a densitometer. In another embodiment, the sensor 40 may be a spectrophotometer. In an embodiment, sensor location component 24 may be a subcomponent of service component 22.

Printing device 12' is shown to include a controller 26. As used in this specification, controller 26 represents generally any combination of elements capable of coordinating the operation of components 16, 18, 20, 22 and 24. In a given implementation, the controller 26 includes a processor 44 and a memory 46. The processor 44 may represent multiple processors, and the memory 46 may represent multiple memories. In an embodiment, the controller 26 may include a number of software components that are stored in a computer-readable medium, such as memory 46, and are executable by processor 44. In this respect, the term "executable" includes a program file that is in a form that can be directly (e.g. machine code) or indirectly (e.g. source code that is to be compiled) performed by the processor 44. An executable program may be stored in any portion or component of memory 46.

COMPONENTS: FIG. 3 is an example block diagram illustrating the physical and logical components of a sensor location module 48. Sensor location module 48 represents generally any combination of hardware and programming configured for use to position a sensor. Sensor location module 48 may be implemented in a number of environments, such as environment 10 of FIG. 1. In the example of FIG. 3, sensor location module 48 is shown to include a fiducial engine 50, a reading engine 52 and an alignment engine 54.

Fiducial engine 50 represents generally any combination of hardware and programming configured to advance a media in a process direction to cause a plurality of fiducials to appear successively within a sensor's focal width. As used in this specification and the appended claims, a "process direction" means a direction in which a media advances past a printhead or other printing element during a printing operation. As used in this specification and the appended claims, a "fiducial" means a rectangle, circle, oval, or other geometrical shape or other visual feature, or a combination of any of the foregoing, that may be placed in the focal width of a sensor and used as a reference point for positioning the sensor. Each fiducial includes a target and a background, with the target superimposed to or overlaying the background. It is not required, in order for the target to be superimposed to or overlay the background, that the target actually be printed over a previously printed background. In embodiments, to save printing costs and to reduce quality issues associated with too much ink on the substrate, the portion of the background to be visually superimposed or overlaid by the target is not printed. The result is that the target is visually superimposed to or visually overlays the background, and such configurations are included within the meaning of "superimposed to", "overlay", "overlaying", and "overlaid" as used in this description and the appended claims.

Each target has a substantially same target width, a substantially same optical density, and a position at a distinct distance from an edge of the media. Each background has an optical density less than the optical density of the targets and greater than an optical density of the media. In an embodiment, each background has a substantially same height as the target with which it corresponds. In an embodiment, each background has a substantially same width, and is substantially aligned in a process direction with the other backgrounds.

In an embodiment, the fiducial engine is connected to print component 18 and is additionally operable to cause printing of the plurality of fiducials on a media first portion, with the fiducials spaced in a process direction. In an embodiment, printing of the plurality of fiducials on the first portion occurs during the printing of a plot on a second portion of the media. In another embodiment, the fiducials may be preprinted on the media. In an embodiment, the plurality of fiducials comprises a repetition of a same pattern of fiducials.

Reading engine 52 represents generally any combination of hardware and programming configured to read an optical density for each fiducial utilizing the sensor 40. The sensor 40 is utilized at a fixed position relative to the edge of the media, and having a focal width substantially the same as the fiducial's target width. In an embodiment, the sensor's 40 readings of the optical densities of the fiducials occur during the printing of a plot on the media second portion.

Alignment engine 54 represents generally any combination of hardware and programming configured to discern, by identifying the fiducial with the highest-read optical density, the fiducial that the sensor is most aligned with. Utilizing data indicative of a position of the discerned fiducial relative to a desired position, the sensor is caused to move to the desired position. Causing movement of the sensor may be accomplished by the alignment engine 54 working in combination with a sensor positioning device 56. In an embodiment, the sensor 40 is an inline sensor mounted on a printhead carriage 32 (FIG. 1), such that the printhead carriage 32 serves as the sensor positioning device 56 and movement of the printhead carriage 32 causes movement of the sensor 40. In an embodiment, the desired position is a position in which the sensor is substantially aligned with a centered target among the plurality of fiducials. As used in this specification and the appended claims, a "centered target" is one of the targets within the plurality of fiducials that is centered, or in the middle, with respect to the other targets, along an axis perpendicular to the process direction.

Figure 4:
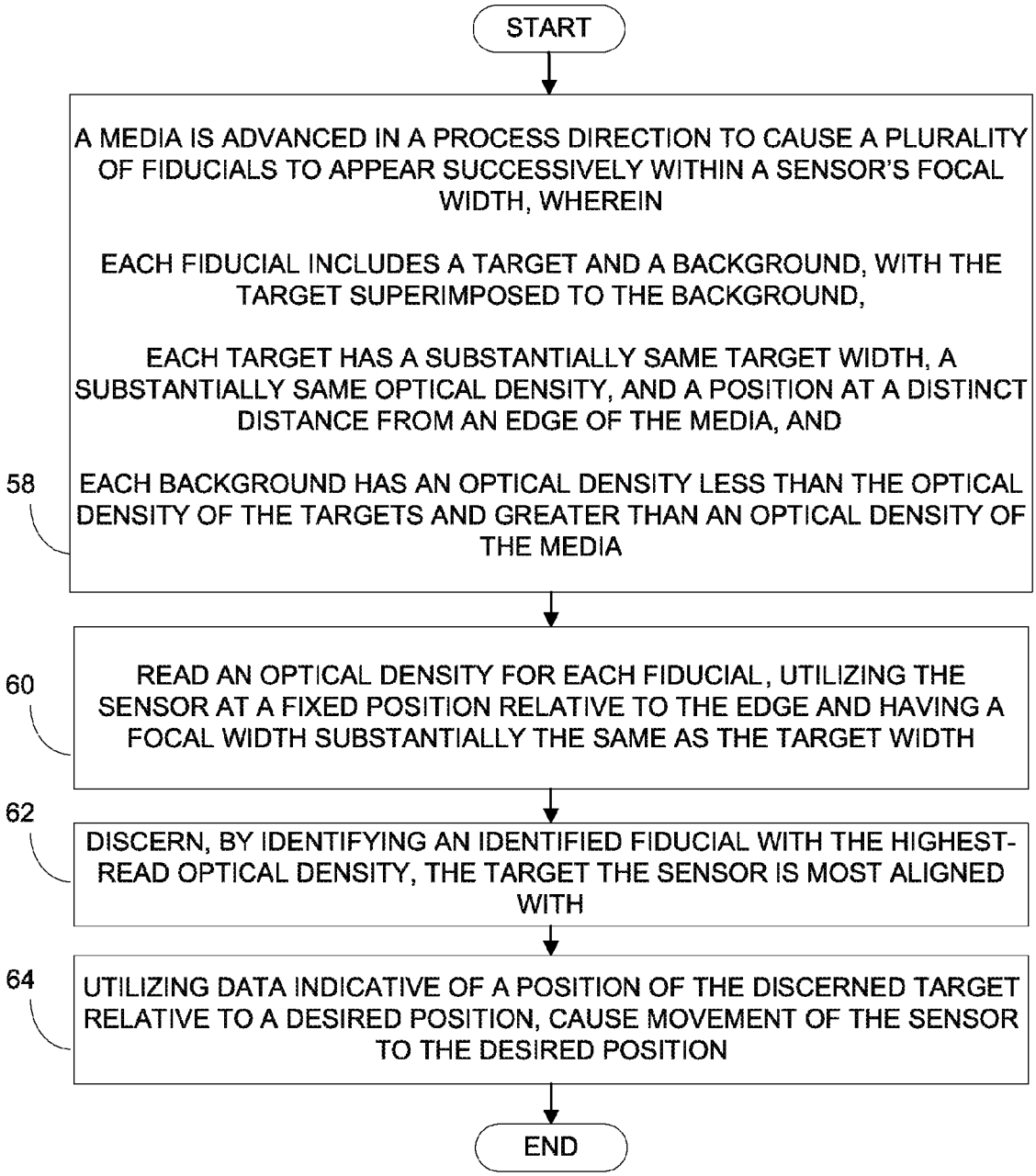
FIGS. 4 and 5 are example flow diagrams depicting embodiments of a method to position a sensor.
Figure 5:
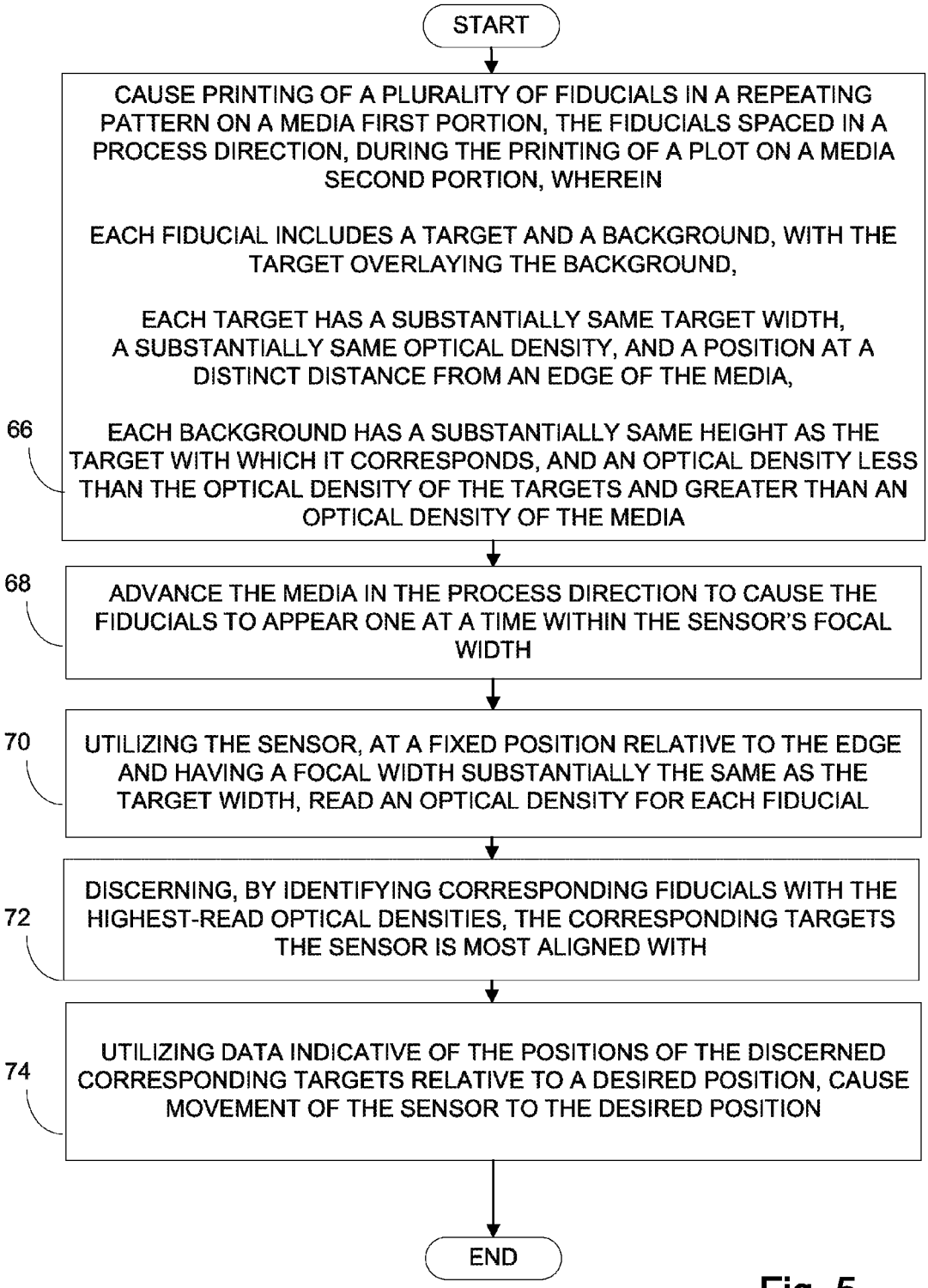

OPERATION: FIGS. 4 and 5 are flow diagrams depicting example embodiments of a method to position a sensor. In discussing FIGS. 4 and 5, reference may be made to the diagrams of FIGS. 1-3 to provide contextual examples. Implementation, however, is not limited to those examples.

Starting with FIG. 4, a media is advanced in a process direction to cause a plurality of fiducials to appear successively within a sensor's focal width (block 58). Each fiducial includes a target and a background, with the target superimposed to the background. Each target has a substantially same target width, a substantially same optical density, and a position at a distinct distance from an edge of the media. Each background has an optical density less than the optical density of the targets and greater than an optical density of the media.

Referring back to FIG. 3, the fiducial engine 50 may be responsible for implementing block 58.

Continuing with the flow diagram of FIG. 4, utilizing the sensor, at a fixed position relative to the edge, and having a focal width substantially the same as the target width, an optical density is read for each fiducial (block 60). Referring back to FIG. 3, the reading engine 52 may be responsible for implementing block 60.

Continuing with the flow diagram of FIG. 4, the fiducial the sensor is most aligned is discerned, by identifying the fiducial with the highest-read optical density (block 62). Referring back to FIG. 3, the alignment engine 54 may be responsible for implementing block 62.

Continuing with the flow diagram of FIG. 4, utilizing data indicative of a position of the discerned fiducial relative to a desired position, the sensor is caused to move to the desired position (block 64). Referring back to FIG. 3, the alignment engine 54 may be responsible for implementing block 64.

Moving on to FIG. 5, in a particular implementation, a plurality of fiducials is caused to be printed in a repeating pattern on a media first portion during the printing of a plot on a media second portion (block 66). The fiducials are spaced in a process direction. Each fiducial includes a target and a background, with the target overlaying the background. Each target has a substantially same target width, a substantially same optical density, and a position at a distinct distance from an edge of the media. Each background has a substantially same height as the target with which it corresponds, and an optical density that is less than the optical density of the targets and greater than an optical density of the media. Referring back to FIG. 3, the fiducial engine 50 may be responsible for implementing block 66.

Continuing with the flow diagram of FIG. 5, the media is advanced in the process direction to cause the fiducials to appear one at a time within the sensor's focal width (block 68). Referring back to FIG. 3, the fiducial engine 50 may be responsible for implementing block 68.

Continuing with the flow diagram of FIG. 5, utilizing the sensor, at a fixed position relative to the edge, and having a focal width substantially the same as the target width, an optical density is read for each fiducial (block 70). Referring back to FIG. 3, the reading engine 52 may be responsible for implementing block 70.

Continuing with the flow diagram of FIG. 5, it is discerned, by identifying corresponding fiducials with the highest-read optical densities, corresponding targets the sensor is most aligned with (block 72). As used in this specification and the appended claims, two or more fiducials are "corresponding fiducials" if such fiducials have substantially the same target to background characteristics, have substantially the same target to edge characteristics, and are in different incidences of the repeating pattern. As used in this specification and the appended claims, a target included within a corresponding fiducial is known as a "corresponding target." Referring back to FIG. 3, the alignment engine 54 may be responsible for implementing block 72.

Continuing with the flow diagram of FIG. 5, utilizing data indicative of a position of the discerned fiducial relative to a desired position, the sensor is caused to move to the desired position (block 74). Referring back to FIG. 3, the alignment engine 54 may be responsible for implementing block 74. In an embodiment, the desired position is a position substantially aligned with a centered fiducial. As used in this specification and the appended claims, a "centered fiducial" means a fiducial that is centered, in an axis transverse to the process direction, with respect to the other fiducials. In an embodiment in which there is a repeating pattern of fiducials, "the other fiducials" means the other fiducials that are in the same incidence pattern as the centered fiducial.

Figure 6:
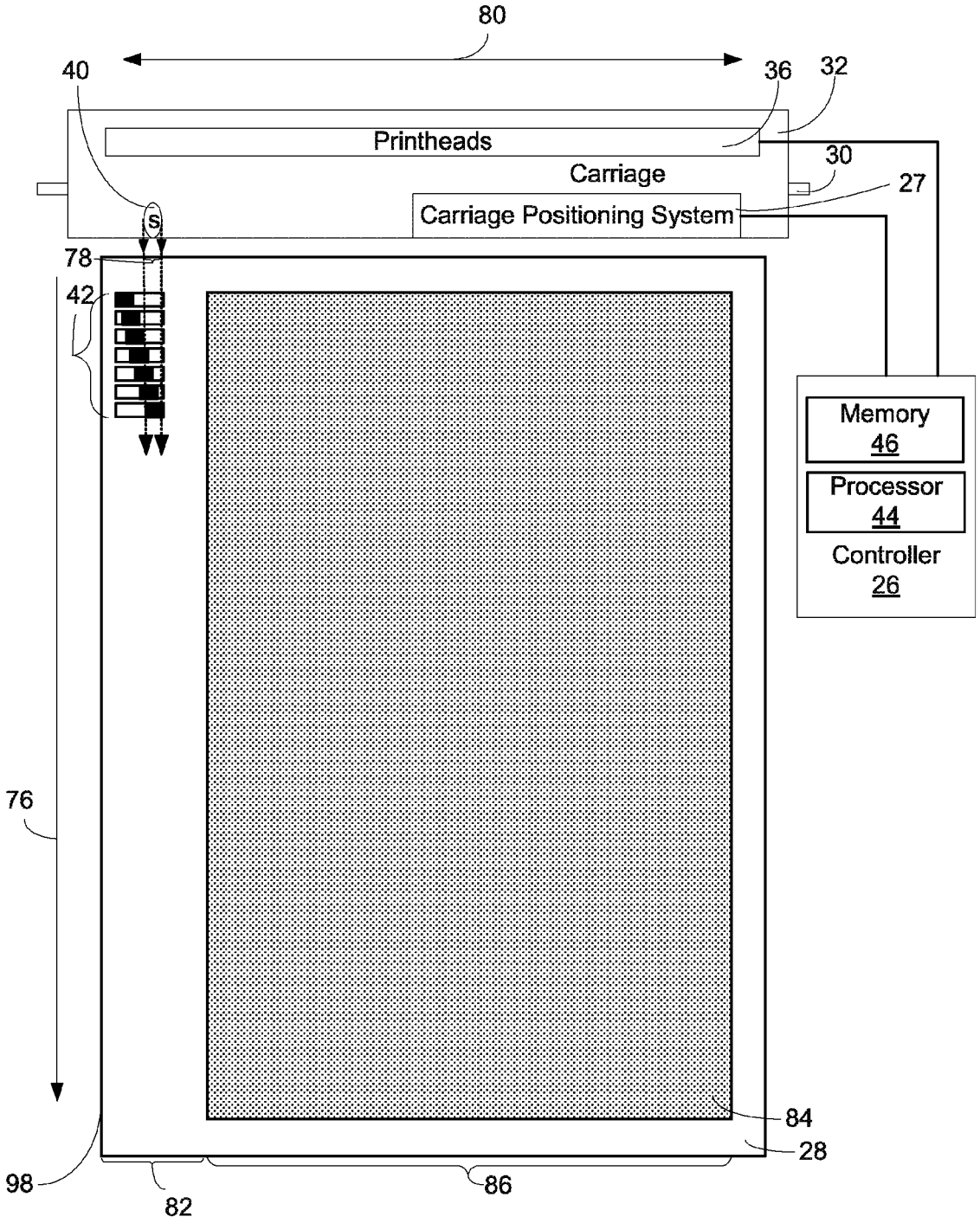
FIG. 6 depicts an example of the method and system to position a sensor, according to an embodiment.

EXAMPLES: FIG. 6 depicts an embodiment of the disclosed method and system for positioning a sensor. A guide rod 30 supports a reciprocating carriage 32. The reciprocating carriage 32 carries printheads 36 configured to dispense ink or other fluid. The carriage 32 also holds an optical sensor 40, the sensor 40 configured to read optical properties or features of fiducials 42 or other markings that are printed upon a media 28. A media transport system (not shown) is configured to advance the media 28 in a process direction 76 such that after the printing of a fiducial by the printheads 36, that fiducial is brought into the focal width 78 of the sensor 40. The carriage 32 is configured to move the printheads 36, and the sensor 40, back and forth along an axis 80 that is substantially perpendicular to the process direction 76.

In the embodiment illustrated in FIG. 6, the printheads 36 print the plurality of fiducials on a first portion 82 of the media, during the printing of a plot 84 on a second portion 86 of the media. In this example, seven fiducials 42 are printed with spaces between the fiducials in the process direction 76. Other embodiments may utilize a smaller or larger number of fiducials. After fiducials 42 are printed they are moved away from the printheads 36 and caused to appear successively within the focal width 78 of the sensor 40 as the media transport system advances the media 28 in the process direction 76. In an embodiment, in part because the sensor 40 and the printheads 36 are held by a same carriage 32, the fiducials 42 appear within the focal width 78 of the sensor 40 just after the fiducials are printed onto the media 28 by the printheads 36.

Figure 7A:
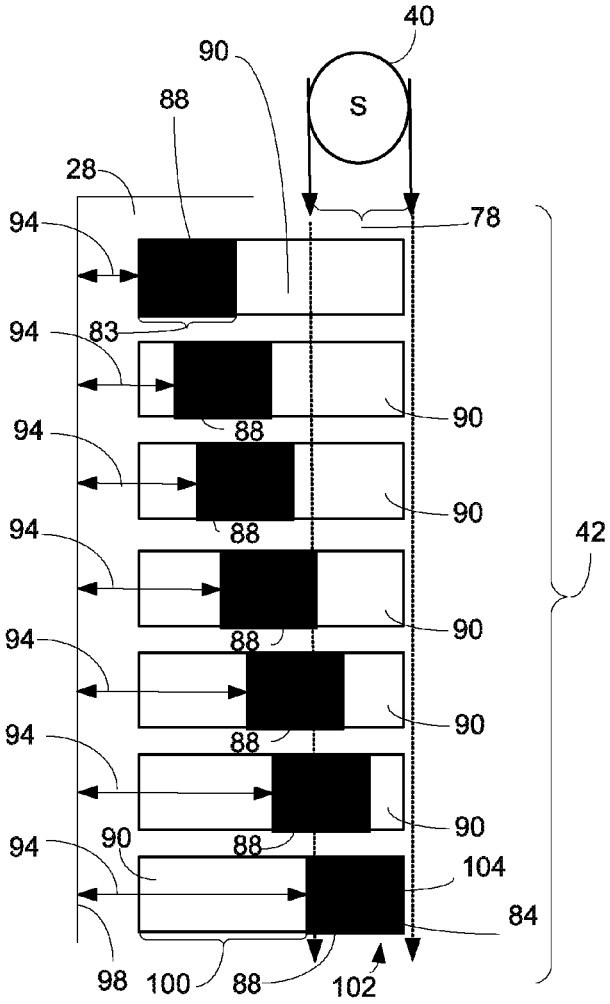
FIGS. 7*a* and 7*b* are close up views of the sensor and fiducials of FIG. 6, providing an example of movement of the sensor to a desired position, according to an embodiment.
Figure 7B:
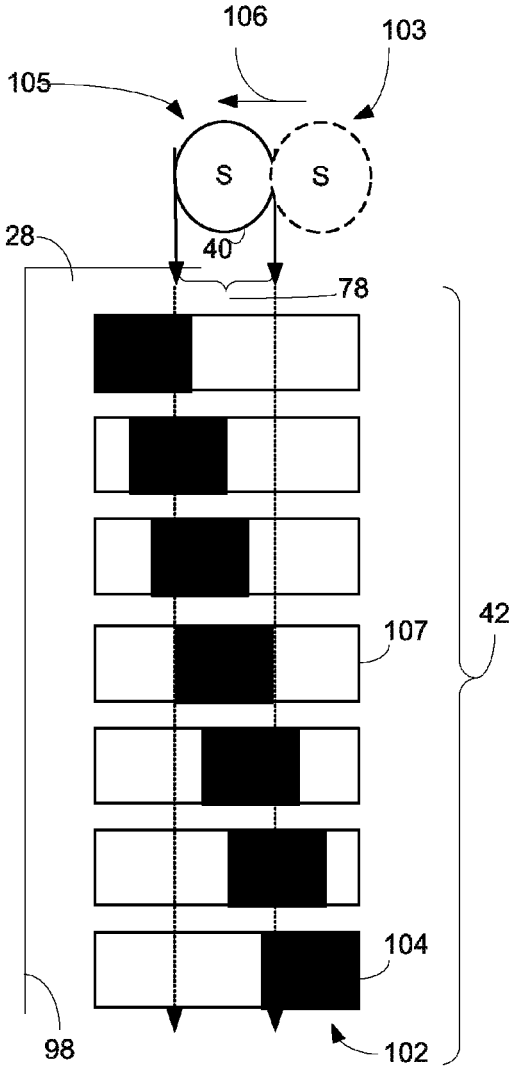
Figure 7C:
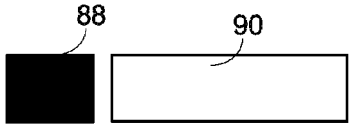
FIG. 7*c* is an exploded view of one of the fiducials of FIG. 7*a*, according to an embodiment.

FIGS. 7*a* and 7*b* are close up views of the sensor and fiducials of FIG. 6, providing an example of movement of the sensor to a desired position, according to an embodiment. Moving to FIG. 7*a*, each of the seven illustrated fiducials includes a target 88 and a background 90, with the target 88 superimposed to the background 40. FIG. 7*c* is an exploded view of any one of the fiducials of FIG. 7*a*, according to an embodiment. Returning to FIG. 7*a*, each target 88 has a substantially same target width 92, a substantially same optical density, and a position at a distinct distance 94 from an edge 98 of the media 28. Each background 90 has an optical density less than the optical density of the targets 88 and greater than an optical density of the media 29. Returning to FIG. 6, in this embodiment, each background 90 has a substantially same width 100 as, and is substantially aligned in the process direction 76, with the other backgrounds. In a particular embodiment, each target has a height of 25 mm, a width of 3 mm, and optical density of 1.7 OD, each background is substantially aligned in the process direction with a height of 25 mm, a total width of 9 mm (with 3 mm superimposed by the target's 3 mm width), and the media has an optical density of 0.2 OD.

Returning to FIG. 6, the sensor 40, utilized at a fixed position relative to the edge 98 of the media 28, and having a focal width 78 substantially the same as the target width 83 (FIG. 7*a*), in combination with the controller 26 reads an optical density for each fiducial 42 as the fiducials 42 are advanced to appear within the focal width 78 of the sensor 40. In the illustrated embodiment, the sensor readings of the optical densities of the fiducials 42 may occur during the printing of a plot 84 on the media second portion 86.

Returning to FIG. 7*a*, it is discerned, by identifying an identified fiducial 102 with the highest-read optical density, that a discerned target 104 comprised within identified fiducial 102 is the target that the sensor 40 is most aligned with. Moving to FIG. 7*b*, utilizing data indicative of a position of the discerned target 104 relative to a desired sensor position 105, the sensor 40 is caused to move 106 to the desired position 105. In an embodiment, the data indicative of the position of the discerned first target 104 relative to the desired position 105 is comprised within a lookup table stored in a memory 46 (FIG. 6). In an embodiment, movement 106 of the sensor from a reading position 103 to the desired position 105 is accomplished by virtue of the controller 26 (FIG. 6), acting in combination with a carriage positioning system 27 (FIG. 6), causing the carriage 32 (FIG. 6) to move along the guide rod 30 (FIG. 6) to position the sensor 40 at the desired position 105. In an embodiment, the desired position is substantially aligned with a centered fiducial 107.

Figure 8:
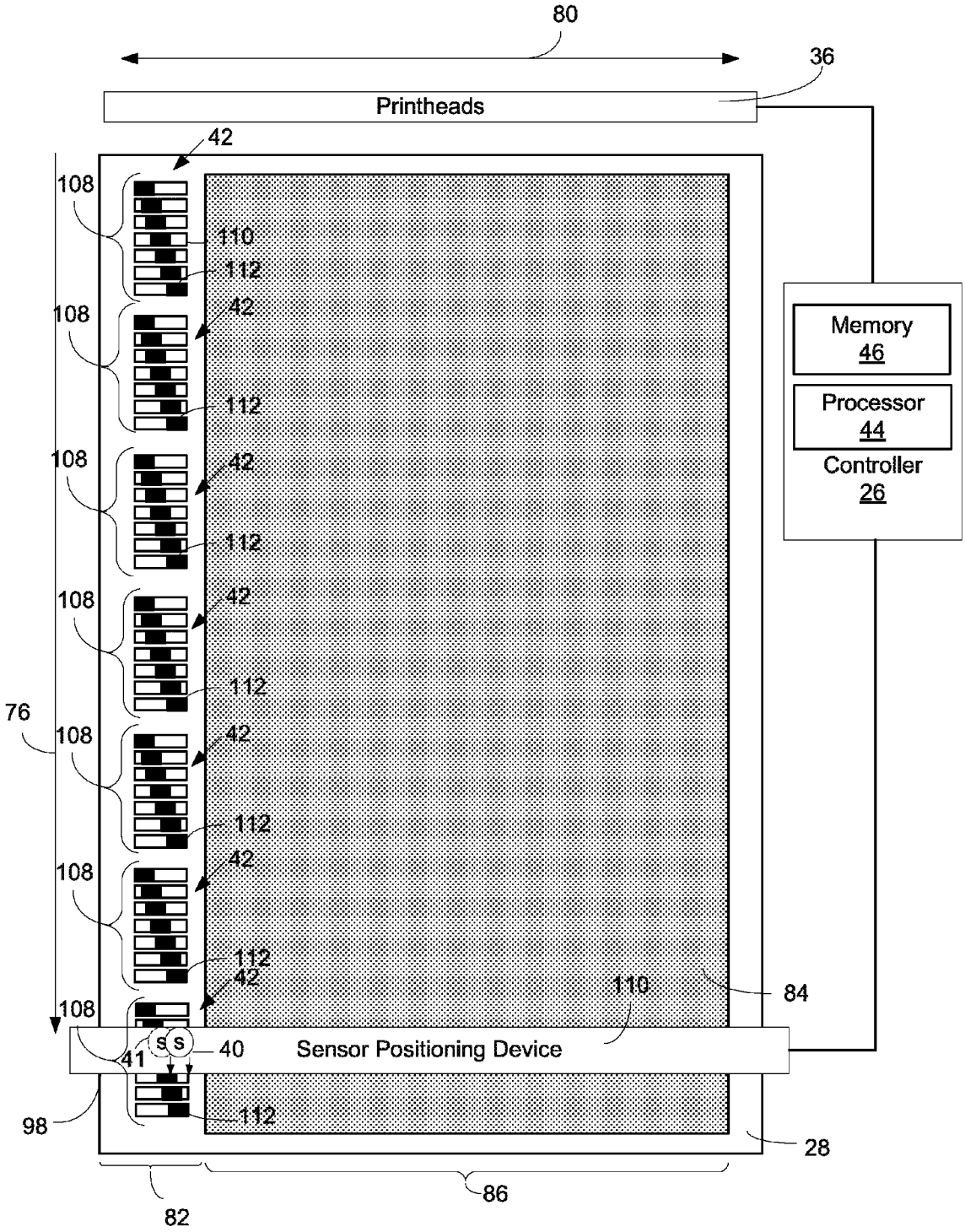
FIG. 8 depicts an example of a method and system to position a sensor utilizing a repeating pattern of fiducials, according to an embodiment.

The diagram of FIG. 8 depicts an embodiment similar to the embodiment described in FIG. 6, differing in the respects described below. In the embodiment illustrated in FIG. 8 seven fiducials 42 are caused to print in a repeating pattern 108 on a media first portion 82. The fiducials of FIG. 8 are substantially identical to those depicted in FIG. 6.

In the embodiment depicted in FIG. 8 the sensor 40 is carried by a sensor positioning device 110 that is separated from the printheads 36. The sensor positioning device 110 is situated at a point in the media transport path downstream from the printheads 36, such that sensor 40 is movable along an axis 80 transverse to the process direction 76. The elapsed time between the printing of a fiducial and that fiducial passing within the sensor's focal width is longer than is the case with the embodiment described in FIG. 6.

The reading, discerning, and causing sensor movement steps described in FIG. 6 embodiment apply to the FIG. 8 embodiment, with the following changes. In the embodiment depicted in FIG. 8, identifying an identified fiducial with the highest-read optical density comprises identifying corresponding fiducials with the highest-read optical density. In the example of FIG. 8, the seventh fiducial in each pattern (counting from top to bottom) has been identified, by the sensor 40 acting in combination with the controller 26, as the corresponding fiducial with the highest-read optical density. Utilizing this information, it is discerned that the target portions comprised within the identified corresponding fiducials are corresponding targets 112 that the sensor 40 is most aligned with. Utilizing data indicative of a position of the discerned corresponding targets 112 relative to a desired sensor position 41, the sensor positioning device 110 is caused to move to the sensor 40 to the desired position 41.

CONCLUSION: The diagrams of FIGS. 1-2 are used to depict example environments in which various embodiments may be implemented. Implementation, however, is not so limited. FIGS. 2-3 show the architecture, functionality, and operation of various embodiments. Various components illustrated in FIGS. 2-3 are defined at least in part as programs. Each such component, portion thereof, or various combinations thereof may represent in whole or in part a module, segment, or portion of code that comprises one or more executable instructions to implement any specified logical function(s). Each component or various combinations thereof may represent a circuit or a number of interconnected circuits to implement the specified logical function(s).

Also, the present disclosure may be embodied in any computer-readable media for use by or in connection with an instruction execution system such as a computer/processor based system or an ASIC (Application Specific Integrated Circuit) or other system that can fetch or obtain the logic from computer-readable media and execute the instructions contained therein. "Computer-readable media" can be any media that can contain, store, or maintain programs and data for use by or in connection with the instruction execution system. Computer readable media can comprise any one of many physical media such as, for example, electronic, magnetic, optical, electromagnetic, or semiconductor media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc.

Although the flow diagrams of FIGS. 4-5 show specific orders of execution, the order of execution may differ from that which is depicted. For example, the order of execution of two or more blocks may be scrambled relative to the order shown. Also, two or more blocks shown in succession may be executed concurrently or with partial concurrence. All such variations are within the scope of the present disclosure.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A non-transitory computer readable medium storing computer executable instructions that, when executed by a processor, causes the processor to:

advance a media in a process direction to cause a plurality of fiducials to appear successively within a sensor's focal width, wherein each fiducial includes a target and a background, with the target superimposed to the background, each target having:

a substantially same target width, a substantially same optical density, and a position at a distinct distance from an edge of the media, and each background having an optical density less than the optical density of the targets and greater than an optical density of the media;

utilize the sensor, at a fixed position relative to the edge and having a focal width substantially the same as the target width, to read an optical density for each fiducial;

discern, by identifying an identified fiducial with the highest-read optical density, the target with which the sensor is most aligned; and utilize data indicative of a position of the discerned target relative to a desired position to cause movement of the sensor to the desired position.

2. The non-transitory computer readable medium of claim 1, wherein the instructions further cause the processor to print the plurality of fiducials on a media first portion, wherein the fiducials are spaced in the process direction.

3. The non-transitory computer readable medium of claim 2, wherein the instructions cause the processor to print the plurality of fiducials on the first portion during printing of a plot on a media second portion.

4. The non-transitory computer readable medium of claim 1, wherein a sensor reading of the optical densities of the fiducials occurs during printing of a plot on a media second portion.

5. The non-transitory computer readable medium of claim 1, wherein each background has a substantially same height as the target with which it corresponds.

6. The non-transitory computer readable medium of claim 1, wherein each background has a substantially same width and is substantially aligned in the process direction with the other backgrounds.

7. The non-transitory computer readable medium of claim 1, wherein the desired position is substantially aligned with a centered target among the plurality of fiducials.

8. The non-transitory computer readable medium of claim 1, wherein the sensor comprises a densitometer.

9. The non-transitory computer readable medium of claim 1, wherein:

the plurality of fiducials comprises a repetition of a pattern, the identified fiducial with the highest-read optical density comprises corresponding fiducials with the highest-read optical density, and data indicative of a position of the discerned target comprises data indicative of a position of discerned corresponding targets.

10. A system to position a sensor, comprising:

a fiducial engine configured to advance a media in a process direction to cause a plurality of fiducials to appear, one at a time, within a sensor's focal width, wherein each fiducial includes a target and a background, with the target overlaying the background, each target having:

a substantially same target width, a substantially same optical density, and a position at a distinct distance from an edge of the media and each background having an optical density less than the optical density of the targets and greater than an optical density of the media;

a reading engine configured to utilize the sensor, at a fixed position relative to the edge and having a focal width substantially the same as the target width, to read an optical density for each fiducial; and an alignment engine configured to:

discern, by identifying an identified fiducial with the highest-read optical density, the target with which the sensor is most aligned; and utilize data indicative of a position of the discerned target relative to a desired position to cause movement of the sensor to the desired position.

11. The system of claim 10, wherein the fiducial engine is further configured to cause printing of the plurality of fiducials on a media first portion, the fiducials spaced in the process direction.

12. The system of claim 11, wherein printing of the plurality of fiducials on the first portion occurs during the printing of a plot on a media second portion.

13. The system of claim 10, wherein a sensor reading of the optical densities of the fiducials occurs during the printing of a plot on a media second portion.

14. The system of claim 10, wherein each background has a substantially same height as the target with which it corresponds.

15. The system of claim 10, wherein each background has a substantially same width and is substantially aligned in the process direction with the other backgrounds.

16. The system of claim 10, wherein the desired position is substantially aligned with a centered target among the plurality of fiducials.

17. The system of claim 10, wherein the data is comprised within a lookup table stored in a memory.

18. The system of claim 10, wherein the sensor comprises a spectrophotometer.

19. The system of claim 10, wherein:

the plurality of fiducials comprises a repetition of a pattern, the identified fiducial with the highest-read optical density comprises corresponding fiducials with the highest-read optical density, and data indicative of a position of the discerned target comprises data indicative of a position of discerned corresponding targets.

20. A method to position a sensor, comprising:

causing printing of a plurality of fiducials in a repeating pattern on a media first portion, the fiducials spaced in a process direction during the printing of a plot on a media second portion, wherein each fiducial includes a target and a background, the target superimposed to the background, each target having:

a substantially same target width, a substantially same optical density, and a position at a distinct distance from an edge of the media, and each background having:

a substantially same height as the target with which it corresponds, an optical density less than the optical density of the targets and greater than an optical density of the media, and a substantially same background width substantially aligned with the other backgrounds in the process direction;

advancing the media in the process direction to cause the fiducials to successively appear within the sensor's focal width;

utilizing the sensor, at a fixed position relative to the edge and having a focal width substantially the same as the target width, to read an optical density for each fiducial;

discerning, by identifying corresponding fiducials with the highest-read optical densities, corresponding targets with which the sensor is most aligned; and utilizing data indicative of positions of the discerned corresponding targets relative to a desired position to cause movement of the sensor to the desired position.

* * * * *